US006012313A

United States Patent [19]

Persico

[11] Patent Number: 6,012,313

[45] Date of Patent: Jan. 11, 2000

[54] PROCESS FOR PRODUCING SEAMLESS TUBES IN COLD ROLLING MILLS AND FOR THE FORMATION AND ELECTRONIC REGULATION OF EXTERNAL THRUST

[76] Inventor: Giuseppe Persico, Via Stazione San Pietro, 40 - 00100 Rome, Italy

[21] Appl. No.: 08/931,597

[22] Filed: Sep. 16, 1997

[30] Foreign Application Priority Data

Sep. 16, 1996 [IT] Italy ..... RM96A0628

[51] Int. Cl.[7] ..... B21B 37/58

[52] U.S. Cl. ..... 72/10.4; 72/10.6; 72/14.5; 72/208; 72/366.2

[58] Field of Search ..... 72/7.2, 9.5, 10.1, 72/10.4, 10.6, 12.1, 13.1, 13.2, 13.3, 13.4, 13.5, 13.6, 13.7, 13.8, 14.4, 14.5, 208, 214, 366.2

[56] References Cited

U.S. PATENT DOCUMENTS

| | | | |
|---|---|---|---|
| 4,090,386 | 5/1978 | Naylor et al. | 72/208 |
| 5,022,250 | 6/1991 | Gerretz et al. | 72/208 |
| 5,125,253 | 6/1992 | Gerretz et al. | 72/208 |

FOREIGN PATENT DOCUMENTS

| | | | |
|---|---|---|---|
| 3706129 | 3/1988 | Germany | 72/214 |
| 4141086 | 6/1992 | Germany | 72/9.5 |
| 62-244511 | 10/1987 | Japan | 72/208 |
| 63-84704 | 4/1988 | Japan | 72/214 |
| 580921 | 11/1977 | U.S.S.R. | 72/214 |

*Primary Examiner*—Joseph J. Hail, III
*Assistant Examiner*—Ed Tolan
*Attorney, Agent, or Firm*—Michael J. Striker

[57] ABSTRACT

Process for creation and adjustment, from one moment to the next, of the external force to apply by the feed assembly to the preformed forging in cold rolling mills of the "pilgrim process" type with rollers and mandrel for producing seamless tubes by means of a computer, in accordance with the geometric parameters of the contours of the rollers and of the mandrel and in accordance with the reaction generated during rolling in the roller supports, for lessening the risk of breaking the tube, reducing unit loads and raising productivity.

7 Claims, 6 Drawing Sheets

PROCESS FOR PRODUCING SEAMLESS TUBES IN COLD ROLLING MILLS AND FOR THE FORMATION AND ELECTRONIC REGULATION OF EXTERNAL THRUST

BACKGROUND OF THE INVENTION

The invention concerns cold rolling mills for the production of ferrous and non-ferrous seamless tubes.

Various processes are employed for making seamless tubes of mild or medium steel.

The best known of these is one that basically uses a perforating mill and a "pilgrim" or "pilgrim process" mill.

In this rolling mill there are two parallel eccentrically contoured rollers turning in opposite directions.

When the rollers open the perforated preformed forging is presented in the direction opposite to that which determines movement of the material during the rolling process.

A cylindrical steel mandrel, of a diameter the same as that of the tube required, is inserted in the hole.

A preformed forging already mounted in position is pressed forward through the opening in the rollers by an hydraulic assembly.

Simultaneously, at each turn of the rollers, forward movements of the forging, introduction of material to be forged by the surfaces of the rollers supported by the cells for loading and stretching the metal, are repeated.

At the end of each stage in the process a fresh length of tube is brought forward by the feed assembly and rolled.

A feed mechanism makes it perform a short backward movement so that a new portion of tube is rolled in the subsequent sequence.

Smoothing and processing racks complete the installation.

It frequently happens that the great forces involved and the high stresses to which the metal is subjected cause breakages in the preformed forging, according to the type of material concerned, when such stresses exceed certain levels.

SUMMARY OF THE INVENTION

The present invention greatly reduces risks of breakage considerably increasing output as will be explained below.

Subject of the invention is a process for creation and regulation of the external forces to be applied to the apparatus that feeds the preformed forging into the cold "pilgrim process" type mill with rollers and mandrel, for making seamless tubes.

In accordance with the geometrical parameters of the contours of the rollers and mandrel, of the coefficient of friction between the preformed forging cylinders and mandrel, and according to the reaction generated in the roller supports, a computer decides how to create and regulate, from one moment to the next, the external force to apply to the feed asembly, obtaining said external force by addition of the outgoing braking power of friction to the nominal limit value of detachment of the tube which said external force would provoke in the absence of longitudinal forces.

The computer calculates said external force based on the following formulae:

$$FE\,eff + L\,res =$$

-continued $$N\left[\pi\mu + \pi\frac{lpma\,r}{lp\,R}\mu \pm \pi\frac{S\,sb}{S\,sb + S\,ma}tg\left(\phi\frac{1}{4}\beta\right) \pm \pi\,tg\left(\phi\frac{1}{4}\beta\right) - \pi\,tg\left(\phi\,ma\frac{lpma\,r}{R\,lp} + A\,an\,rit\right)\right]$$

where:

EF lim: nominal limit external force

EF eff: effective external force

L res: residual longitudinal rolling force

N: normal force on the portion being processed $\mu$: coefficient of friction lpma: length of arc of contact of part of mandrel r: radius of the mandrel R: radius of the preformed forging S sb: section of the preformed forging S ma: section of the mandrel ψ: angle of inclination of the contour of portion being processed ψ ma: angle of inclination of the mandrel contour β=z/lp z: distance between points of contour of portion being processed and the center of rollers lp: length of the arc of contact A an rit: extra outgoing braking power of friction to avoid detachment during the return stroke A an eff: extra outgoing force of friction to raise EF from nominal to effective value.

Forward movement of the preformed forging is obtained by alternate motion of a hydraulic device whose external force of feed is generated by a pump that operates a hydraulic cylinder and is controlled by a computer operated regulating device, while the reaction that develops on the rollers is recorded continuously by a sensor mounted on said supports.

Due to the effect of pressure generated by the pump and overcoming resistance set up by a return spring, after pushing forward the preformed forging during one phase, the feed assembly automatically resumes its starting position after pressure by fluid from the pump and reaction by the spring have ceased.

A feed mechanism re-establishes contact between said feed assembly and the preformed forging at the end of each phase to allow a subsequent portion of tube to be processed.

In one preferred type of execution a thrust means causes the hydraulic cylinder to act on a threaded bush which screws onto a threaded bar that, by an axial motion, pushes the preformed forging. At the end of each phase of forward movement, the screw is withdrawn and returned to the means of thrust, and is made to rotate on the bar by a kinematic unit operated by a hydraulic and pneumatic cylinder under pressure generated by a motor-driven compressor.

The two racks on the mill, for processing and for smoothing, are situated on two different planes.

Movement of the first is oblique and that of the second horizontal.

The racks are placed to permit passage from one to the other.

Movement of the pinion for the processing rack is spiral while that for the smoothing rack is circular.

The invention offers evident advantages.

With the process subject of the invention, the value of the thrust force produces an effective resistance in the material to warping close to the ideal value that would be obtained in the absence of forces of friction.

Longitudinal and orthogonal compression on the tube being rolled is reduced.

Orthogonal stresses on the material are substantially independent from forward movement and longitudinal stresses are practically non-existent.

Cutting forces on the tube and residual tension are eliminated with consequent elimination of anomalous warping.

Forces of friction and wear are reduced.

The possibility is offered of being able to roll, without risk of breakage, alloys whose yield points are very close to their ultimate tensile strengths.

The forces of reaction on the preformed forging are absorbed by the support of the pump during the forward stroke and by the fixed plane joined to the structure of the machine during the return stroke so that said forces are absorbed by said structure.

With the invented process unit loads can be more than halved and output can be more than trebled.

Characteristics and purposes of the invention will be made still clearer by the following example of its execution illustrated by diagrammatically drawn figures.

Figure 1:
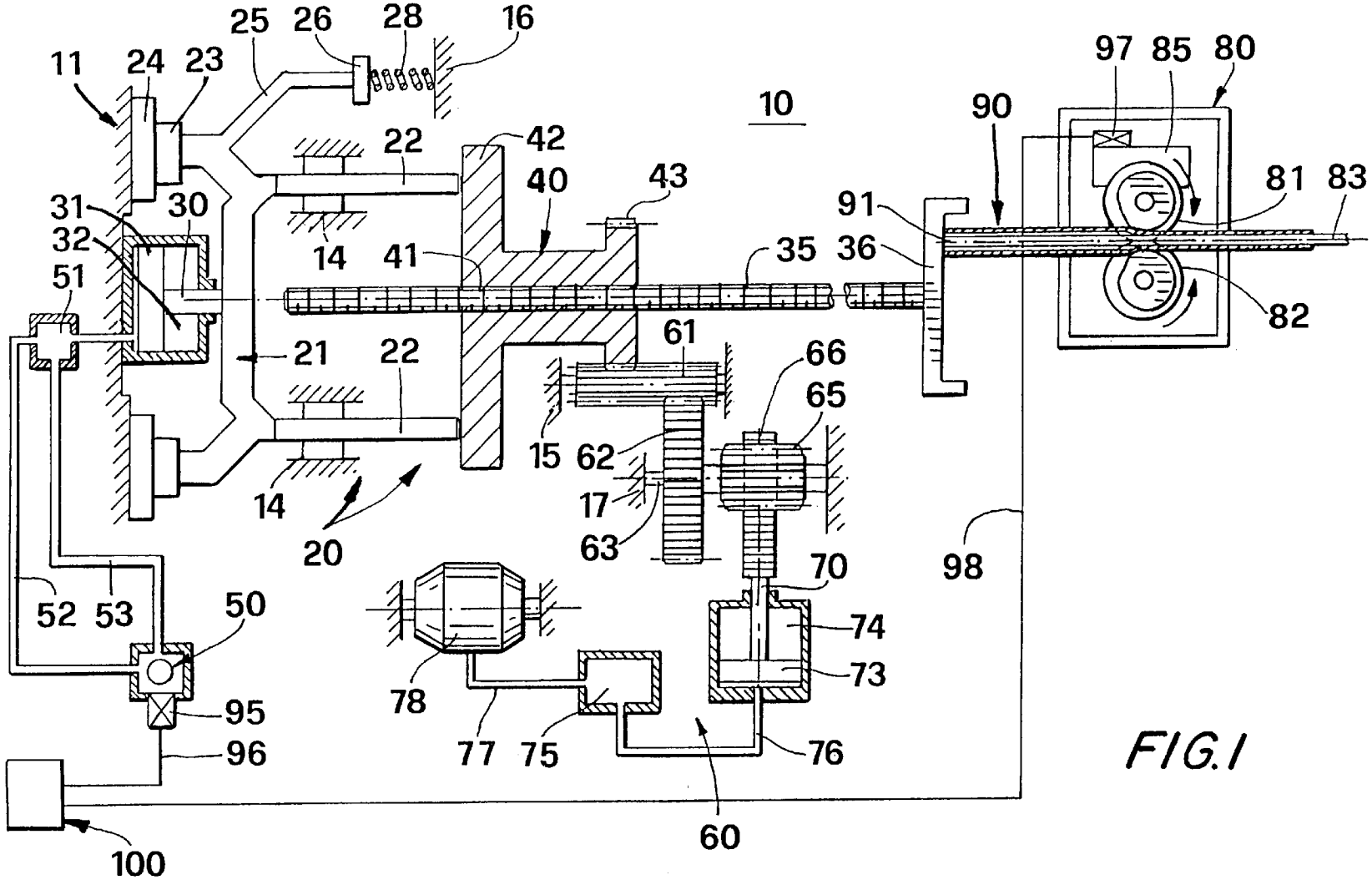
FIG. 1 The rolling mill showing the hydraulic feed assembly comprising a means of thrust acting on an axial threaded bar by a threaded bush, at the start of the stage of forward movement.

The rolling mill 10 comprises the fixed structure 11, the hydraulic feed assembly 20, the feed mechanism 60 and the load cell 80 with support 85 for the cam-contoured rollers 81, 82.

The hydraulic feed assembly 20 comprises the thrust body 21 with front arms 22 freely sliding on supports 14 and the rear feet 23 that make contact on the plate 24 fixed to the structure 11, the threaded bar 35 on which the threaded bush 40 is screwed, and the hydraulic pump 50.

The small lateral arm 25, parallel to arms 22, with the plate 26 at its end, is mounted on one foot.

Between said plate 26 and a support 16, mounted on the fixed structure of the rolling mill, is a helical compression spring 28 that tends to press the feet 23 on the body 21 against the large plate 24 on the fixed structure 11.

Fixed to and aligned with the thrust body 21 is the shank 30 of a piston 31 sliding inside the hydraulic cylinder 32 fixed to the structure 11.

Said hydraulic cylinder 32 is operated by the pump 50 that periodically sets in motion the piston 31 through the valve 51 and ducts 52 and 53. The threaded bar 35, that slides axially on supports fixed to the structure 11 of the rolling mill, comprises a head 36 at its end facing the load cell 80.

Said threaded bar 35 is coaxial with the thrust body 21 and piston 31. At the back of the bush 40 with thread 41 is the disk 42 and at the front the gear wheel 43.

The feed mechanism 60 comprises the oblong pinion 61 freely turning on supports 15, fixed to the structure 11 of the rolling mill, one side of the pinion engaging with the gear wheel 43 and the other side with the gear wheel 62 fixed to the shaft 63 turning freely on supports 17 of the structure 11 of the rolling mill.

Fixed to said shaft 63 is the oblong pinion 65 that engages with the rack 66 fixed orthogonally to the shaft 70 of the piston 73 of the compressed air cylinder 74, mounted on the fixed structure 11 of the rolling mill.

Said cylinder is fed through the valve 75 and ducts 76, 77 by the compressor 78.

Visible in the load cell 80 is the preformed forging 90 undergoing processing, and the mandrel 83.

As FIG. 1 shows, the rear end 91 of the tube 90 rests on the head 36 of the bar 35.

The pump 50 is fitted with an electronic sensor 95 connected by the cable 96 to the computer 100.

Similarly, an electronic sensor 97 on the support 85 of cylinders 81, 82 is connected by cable 98 to the computer 100.

Figure 2:
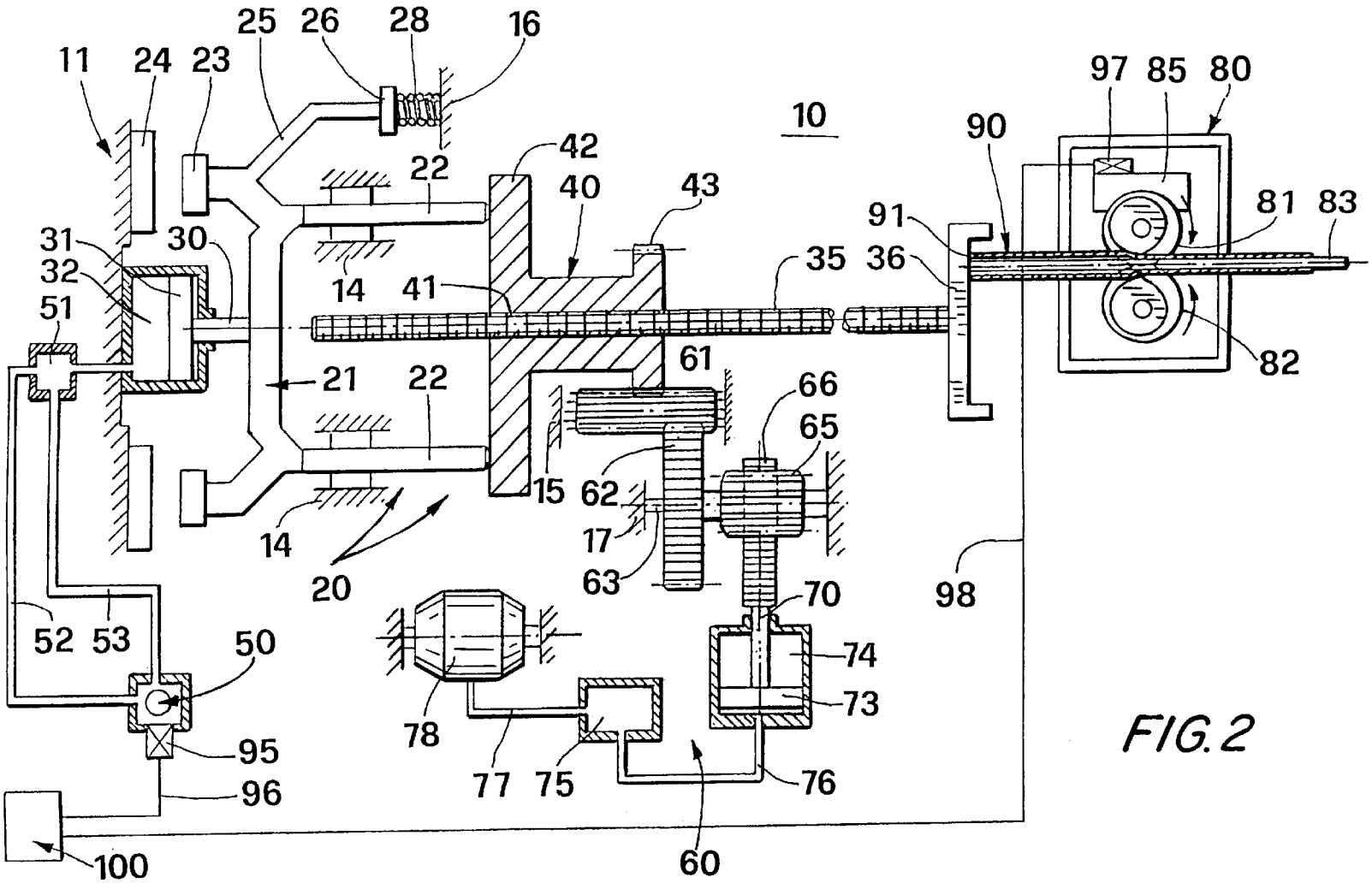
FIG. 2 As above with the feed assembly having terminated its advance.
Figure 3:
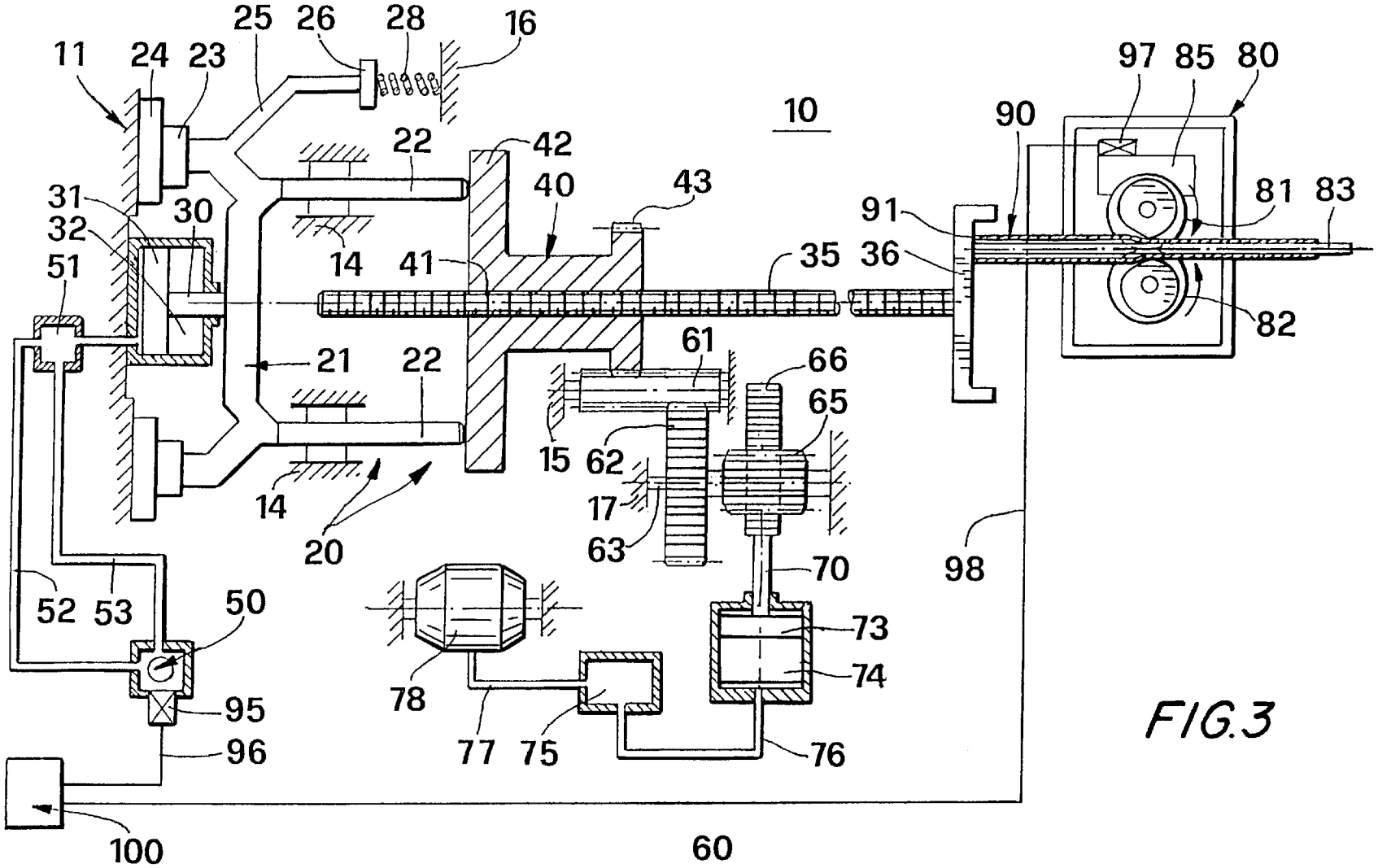
FIG. 3 As above when, at the end of the stage, a feed mechanism has slightly withdrawn the threaded bush towards the means of thrust to start processing another length of preformed forging.

As seen in FIG. 1, at the start of a feed stage, the feet 23 of the thrust body 21 of the hydraulic feed assembly are pressed against the large plate 24 of the fixed structure of the mill by the compression spring 28. Overcoming resistance set up by the spring 28, the pump 50 moves the piston 31 and therefore the thrust body 21 which in turn, by pressing on the disk 42, creates thrust on the threaded bush 40, drawing along by an axial movement the threaded bar 35 which, through its head 36, transfers the thrust to the preformed tube 90 between rollers 81, 82 (FIG. 2).

At this point the valve 51 of the pump 50 empties the cylinder 32 and so, through the spring 28, returns the body 21 to its initial position.

By means of the valve 75 of the compressor 78, the feed mechanism 60, through the piston 70, the kinematic mechanism 61–66 and the gear wheel 43, causes the bush 40 to rotate round the threaded bar 35 until its disk 42 resumes contact with the arms 22 of the thrust body 21.

It will thus be clear that said action by the feed mechanism enables the hydraulic feed assembly to press further forward, in a subsequent stage, the preformed tube 90 between the rollers 81 and 82.

The same stages are later repeated to complete processing on the tube 90 pressed internally by the mandrel 83 and externally by rollers 81, 82.

The geometrical parameters of the mandrel and rollers, as well as the coefficient of friction, are previously entered in the computer.

In accordance with the formula already given and taking into account the actual reaction, measured by the sensor 97, on the support 85 of the rollers, the computer determines, by means of the electronic regulator 95, action by the pump 50 to create and adjust, moment by moment, the external force applied to the feed assembly.

Figure 4:
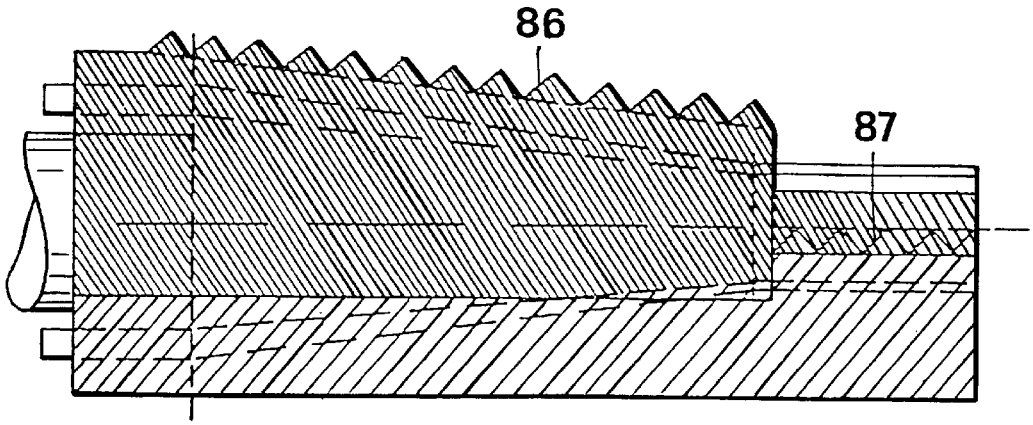
FIG. 4. Longitudinal section of a rack.
Figure 5:
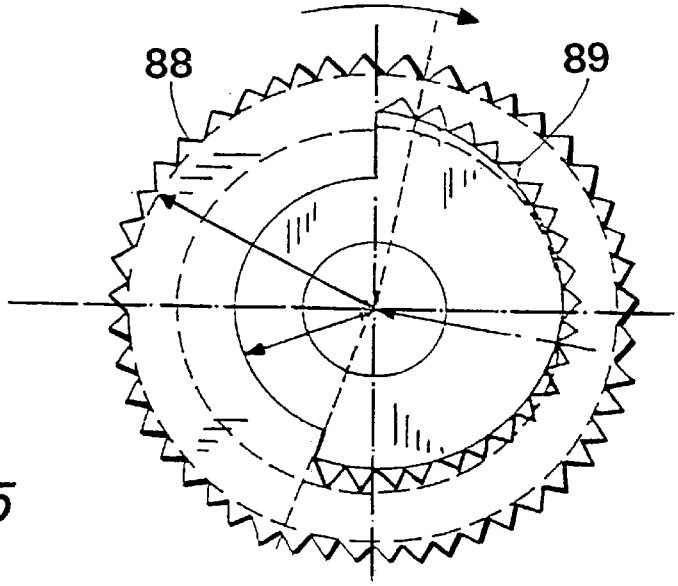
FIG. 5 Front view of the pinions.
Figure 5A:
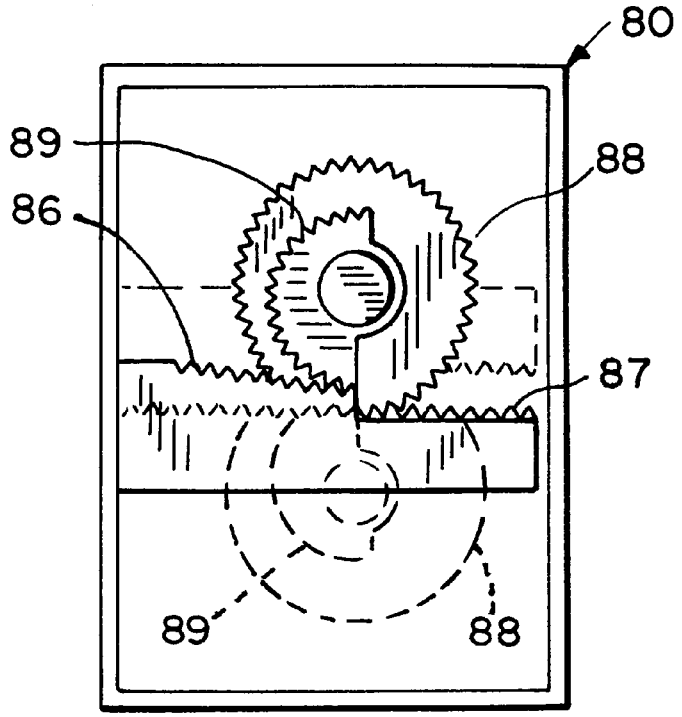
FIGS. 5*a* and 5*b* are views showing details of processing and smoothing racks with respective pinions.
Figure 5B:
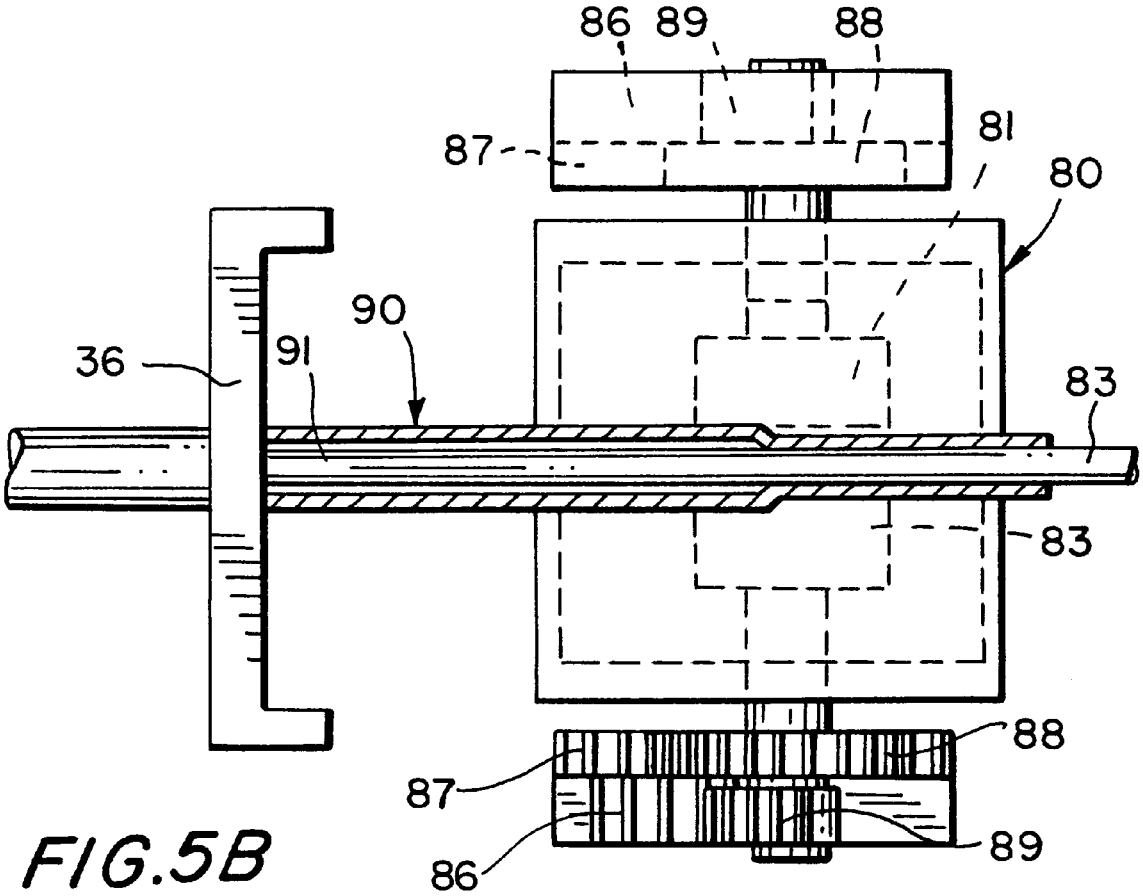
Figure 6:
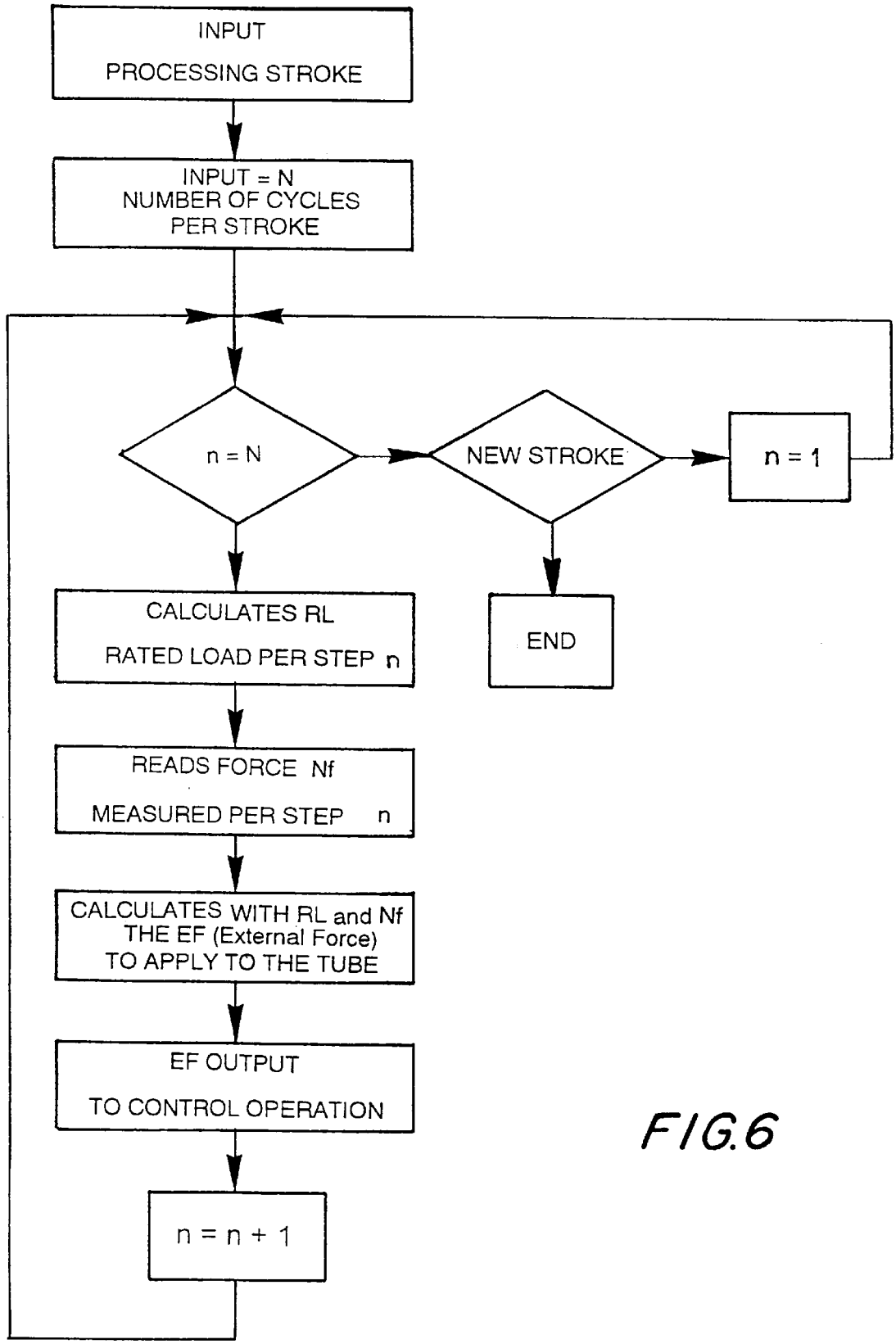
FIG. 6 Wiring diagram.

Said force is calculated by adding the value of the outgoing braking power of friction to the nominal limit value of detachment of the tube that said external force would possess in the absence of longitudinal tensions. FIGS. 4, 5 and 5*a* illustrate the processing rack 86 and smoothing rack 87 with their respective pinions 88, 89.

Optimum timing for the rolling mill is 140 strokes/min or, in other words, 1 stroke every 0.42857 of a second.

As the active phase is the outgoing one and as its time is the same as that of the return phase, the order must be given for a timing of 0.42857/2 sec.

The external force to apply for strict execution of the active phase must be revised at least 10 times per cycle and therefore every 21.43 min/sec.

I claim:

1. Process for creation and regulation of an external force to apply to a feed assembly of preformed forgings in cold rolling mills with rollers and mandrel, processing and smoothing racks, of the "pilgrim process" type for producing seamless tubes, in which said external force is calculated by a computer in accordance with geometric parameters of contours of the rollers and mandrel, with a value of a coefficient of friction between the preformed forging, rollers and mandrel and in accordance with a reaction generated in roller supports for the rollers, in which the external force applied to the feed assembly is calculated by the computer based on the following formulae:

$$FE\,eff + L\,res = N\left[\pi\mu + \pi\frac{lpma}{lpR}\mu \pm \pi\frac{Ssb}{Ssb+Sma}tg\left(\phi\frac{1}{4}\beta\right) \pm \pi\,tg\left(\phi\frac{1}{4}\beta\right) - \pi\,tg\left(\phi\,ma\frac{Lpmar}{Rlp} + A\,an\,rit\right)\right]$$

L res=A an eff where:

EF lim: nominal limit external force

EF eff: effective external force

L res: residual longitudinal rolling force

Ns: normal force on the portion being processed $\mu$: coefficient of friction lpma: Length of arc of contact of part of mandrel r: radius of mandrel R: radius of preformed forging S sb: section of preformed forging S ma: section of mandrel ψ: angle of inclination of portion being processed ψ ma: angle of inclination of mandrel contour β=z/lp z: distance between points of contour of portion processed and center of rollers.

lp: length of arc of contact

A an rit: extra outgoing friction braking power to avoid detachment during return stroke A an eff: extra outgoing force of friction to raise EF from nominal to effective value.

2. Process as in claim 1, in which said external force is created and adjusted by adding the value of the outgoing braking power of friction to the nominal limit value of detachment of the tube that said external force would possess in the absence of longitudinal tensions.

3. Process as in claim 1, in which forward movement of the preformed forging is determined by the alternate motion of a hydraulic feed assembly, comprising a thrust body, wherein the external force of feed is generated by a pump, working a hydraulic cylinder, controlled by a computer-operated regulating device while the reaction that develops on the roller supports is recorded, moment by moment, by a sensor mounted on said supports.

4. Process as in claim 3, in which the thrust body in the hydraulic feed assembly, after the preformed forging has moved forward, during one phase, due to pressure generated by the pump and overcoming resistance set up by a return spring, automatically returns to its starting condition following cessation of both pressure by the pump fluid and reaction of the spring.

5. Process as in claim 3, in which a feed mechanism re-makes contact between said feed assembly and the preformed forging at the end of each phase to enable a further portion of the tube to be brought foward for processing.

6. Process for creation and regulation of an external force to apply to a feed assembly of preformed forgings in cold rolling mills with rollers and mandrel, processing and smoothing racks, of the "pilgrim process" type for producing seamless tubes, in which said external force is calculated by a computer in accordance with geometric parameters of contours of the rollers and mandrel, with a value of a coefficient of friction between the preformed forging, rollers and mandrel and in accordance with a reaction generated in the roller supports for the rollers, in which forward movement of the preformed forging is determined by an alternate motion of a hydraulic feed assembly, comprising a thrust body, wherein the external force of feed is generated by a pump, working a hydraulic cylinder, controlled by a computer-operated regulating device while the reaction that develops on the roller supports is recorded, moment by moment, by a sensor mounted on said supports, in which, by means of the thrust body, the hydraulic cylinder acts on a body of a threaded bush that screws onto a threaded bar which, making an axial movement, presses on the preformed forging while, at a close of each stage of feed, the threaded bush is moved back towards the thrust body and the bush is rotated on the bar by a kinematic unit worked by a hydraulic and pneumatic cylinder following an effect of pressure generated by a motor compressor.

7. Process for creation and regulation of an external force to apply to a feed assembly of preformed forgings in cold rolling mills with rollers and mandrel, processing and smoothing racks having pinions and first and second movements, of the "pilgrim process" type for producing seamless tubes, in which said external force is calculated by a computer in accordance with geometric parameters of contours of the rollers and mandrel, with a value of a coefficient of friction between the preformed forging, rollers and mandrel and in accordance with a reaction generated in roller supports for the rollers, in which the processing and smoothing racks in the rolling mill, the first making a oblique movement and the second a horizontal movement, are situated on two different levels and so placed as to permit passage from one rack to the other, the respective movements of the pinions for said racks being a spiral movement for the first and a circular movement for the second.

* * * * *